US005259517A

United States Patent [19]

Pancoe

[11] Patent Number: 5,259,517

[45] Date of Patent: Nov. 9, 1993

[54] VERTICALLY SPACED MULTIPLE RAIL DISPLAY RACKS

[76] Inventor: Tod Pancoe, 4218 #A Forest Hill Rd., Colorado Springs, Colo. 80907

[21] Appl. No.: 969,782

[22] Filed: Oct. 29, 1992

[51] Int. Cl.[5] ..... A47F 5/00

[52] U.S. Cl. ..... 211/41; 211/46; 211/163; 40/124

[58] Field of Search ..... 211/40, 41, 163, 4, 211/162, 46; 40/124

[56] References Cited

U.S. PATENT DOCUMENTS

| | | | |
|---|---|---|---|
| 2,677,347 | 5/1954 | Bump | 40/124 X |
| 3,810,323 | 5/1974 | Lowe | 40/124 |
| 3,924,749 | 12/1975 | Weston | 211/4 |
| 3,938,665 | 2/1976 | Rumble | 211/163 X |
| 3,960,273 | 6/1976 | Weston | 211/4 |
| 4,385,459 | 5/1983 | McGrath et al. | 40/124 X |
| 4,432,460 | 2/1984 | Bell | 211/50 |
| 4,475,659 | 10/1984 | Wells et al. | 40/124 X |
| 4,940,147 | 7/1990 | Hunt | 211/40 |
| 4,951,826 | 8/1990 | Tompkins | 211/40 |
| 5,040,687 | 8/1991 | Whittington | 211/40 |

*Primary Examiner*—Robert W. Gibson, Jr.
*Attorney, Agent, or Firm*—John R. Flanagan

[57] ABSTRACT

A display rack includes a plurality of elongated rails, a frame structure for supporting the rails in a common plane and in a generally parallel and vertically spaced relation to one another so as to locate the rails at uniform distances from one another, and a plurality of grooves defining sets of tracks along facing longitudinal surfaces of the rails. The grooves extend between and are open at opposite ends of the rails for holding thin rectangular shaped cards therebetween which are receivable from either opposite ends of the rails such that the opposite end edges of the cards extend within the sets of facing tracks of the rails and the cards extend between the rails.

22 Claims, 2 Drawing Sheets

VERTICALLY SPACED MULTIPLE RAIL DISPLAY RACKS

BACKGROUND OF THE INVENTION

1. Field of the Invention

The present invention generally relates to display racks and, more particularly, is concerned with a display rack with vertically spaced multiple rails having parallel facing grooves for holding card-like objects therebetween which have been received from either opposite ends of the rails.

2. Description of the Prior Art

Small thin rectangular shaped cards, which are commonly referred to as trading cards, are collected and traded by many persons. The cards are typically kept in the pockets of individual thin plastic sleeves or cases being open only at one end, such as the top end. Many card collections are stored out-of-view in drawers, albums or boxes.

Persons possessing trading cards are universally proud of their collections and would like to be able to examine and look at the cards frequently and show them to others. However, the above-mentioned normal ways that persons store their collections do not enable easy access to the cards.

Consequently, a need exists for a display structure which will allow persons to safely and reliably store their trading cards and like objects while displaying them in an attractive way at the same time.

SUMMARY OF THE INVENTION

The present invention provides a display rack designed to satisfy the aforementioned need. The display rack employs vertically spaced multiple rails with parallel facing grooves for holding card-like objects therebetween which have been received from either opposite ends of the rails. The space between the rails is open from both the front and back of the display rack such that opposite sides of the objects can be viewed. Where the objects are trading cards, both the back and front of the cards can thus be observed without removing the cards from the display rack.

Accordingly, the present invention is directed to a display rack which comprises: (a) a plurality of elongated rails having spaced opposite ends; (b) means for supporting the rails in a common plane and in a generally parallel and vertically spaced relation to one another so as to locate at least a pair of rails at a uniform distance from one another, the rails having longitudinal surfaces facing toward one another; and (c) means for defining tracks along the facing longitudinal surfaces of the rails, the tracks extending between and open at opposite ends of the rails for holding card-like objects therebetween that have been received from either opposite end of the rails such that the opposite end edges of the card-like objects extend within the tracks of the longitudinal surfaces of the pair of rails and the card-like objects extending between the rails.

The track defining means formed along the facing longitudinal surfaces of the rails are linear grooves recessed into the surfaces which extend between and are open at opposite ends of the rails. A downwardly open groove is formed in a lower longitudinal surface of an uppermost one of the rails. An upwardly open groove is formed in an upper longitudinal surface of a lowermost one of the rails. A pair of grooves are formed in the opposite upper and lower longitudinal surfaces of one or more middle rails which grooves face in opposite directions.

There are two different embodiments of the display rack of the present invention. In a first embodiment, the display rack is a wall-mounted unit in which the rail supporting means includes a pair of tie members extending in generally transverse relation to the rails and along one of the front or back sides of opposite end portions of the rails where the tie members are rigidly attached to the rails without obstructing the open opposite ends of the tracks on the rails.

In a second embodiment, the display rack is a freestanding unit in which the rail supporting means includes the tie members mentioned above and also includes a freestanding mounting frame which surrounds and pivotally supports the rail and tie member structure for rotational movement relative to the mounting frame. The mounting frame includes a pair of upright side members and a pair of top and bottom members extending between and rigidly connecting the upright side members. Also, the display rack includes a pair of base members which are attached to either lower ends of the side members or to the bottom member of the mounting frame and are configured to support the mounting frame and the rail and tie member structure therewith in an upright freestanding relation. The uppermost rail and top member are pivotally coupled together by an upper pin. The lowermost rail and bottom member is pivotally coupled together by a lower pin. The upper pin extends above the top member of the mounting frame and has a knob secured on its upper end for manually gripping to rotate the rail and tie member structure.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
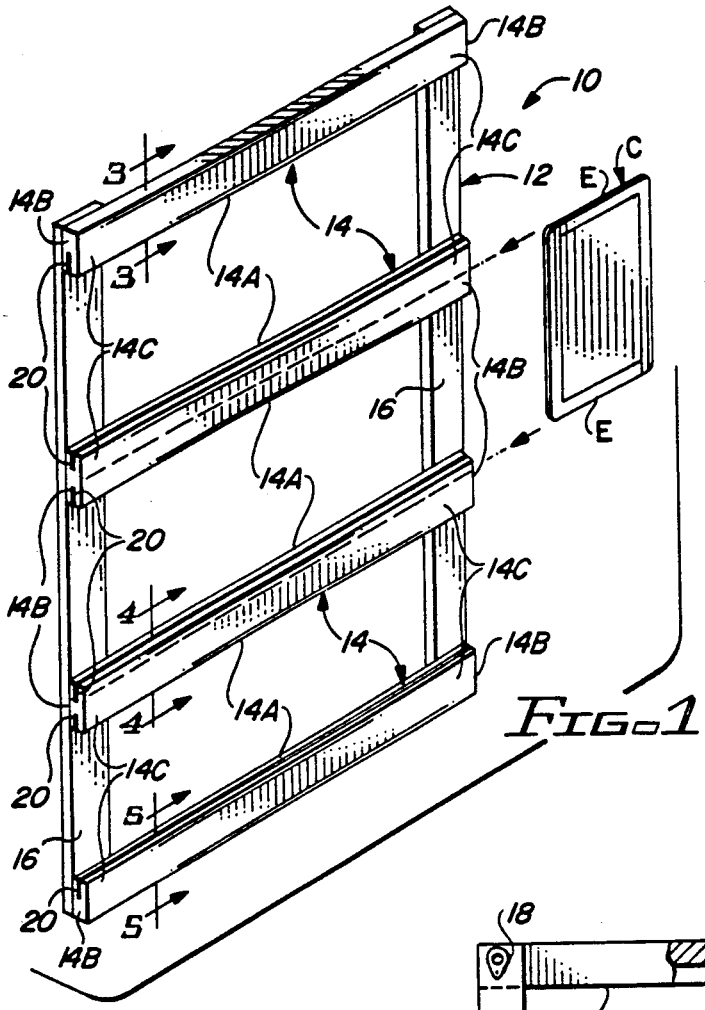
FIG. 1 is a perspective view of a wall-mounted embodiment of the display rack of the present invention.

Referring to the drawings and particularly to FIGS. 1-5, there is illustrated a first embodiment of a display rack of the present invention, being generally designated 10. The first embodiment of the display rack 10 is a wall-mountable unit.

Basically, the display rack 10 includes a display structure 12 formed by a plurality of elongated straight rails 14 and a pair of elongated tie members 16. The tie members 16 are preferably flat straight strips which are attached to the rails 14. The rails 14 are supported by the tie members 16 in a common plane and in a generally parallel and vertically spaced relation to one another so as to located the rails 14 at uniform or constant distances from one another. A pair of eyelet elements 18 are attached to upper end portions of the tie members 16 for use in hanging the display structure 12 on a wall or the like. The rails 14 and tie members 16 can be fabricated from any suitable material, for example, wood or plastic. While the illustrated embodiment has four rails 14, it should be understood that there may be two, three or more than four rails.

The display rack 10 also includes a plurality of linear grooves 20 defining sets of tracks along facing and generally parallel extending longitudinal surfaces 14A of the rails 14. The grooves 20 extend between and are open at opposite ends of the rails 14 for holding thin rectangular shaped cards C, such as trading cards or the like, therebetween. Given such configuration of the grooves 20, the cards can be received and withdrawn from either opposite end 14B of the rails 14 and can be slid unobstructed from one end 14B of each rail to the opposite end 14B. When received between the rails 14, the opposite upper and lower end edges E of the cards C will extend within the sets of facing grooves 20 of the rails 14 and the cards C will extend between the vertically spaced rails 14.

Figure 3:
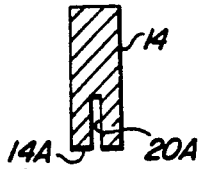
FIG. 3 is an enlarged cross-sectional view of an uppermost one of the rails of the wall-mounted display rack taken along line 3—3 of FIG. 1.
Figure 4:
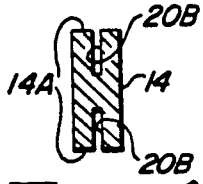
FIG. 4 is an enlarged cross-sectional view of a middle one of the rails of the display rack taken along line 4—4 of FIG. 1.
Figure 5:
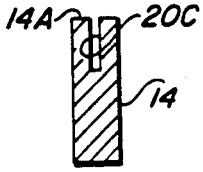
FIG. 5 is an enlarged cross-sectional view of a lowermost one of the rails of the display rack taken along line 5—5 of FIG. 1.
Figure 2:
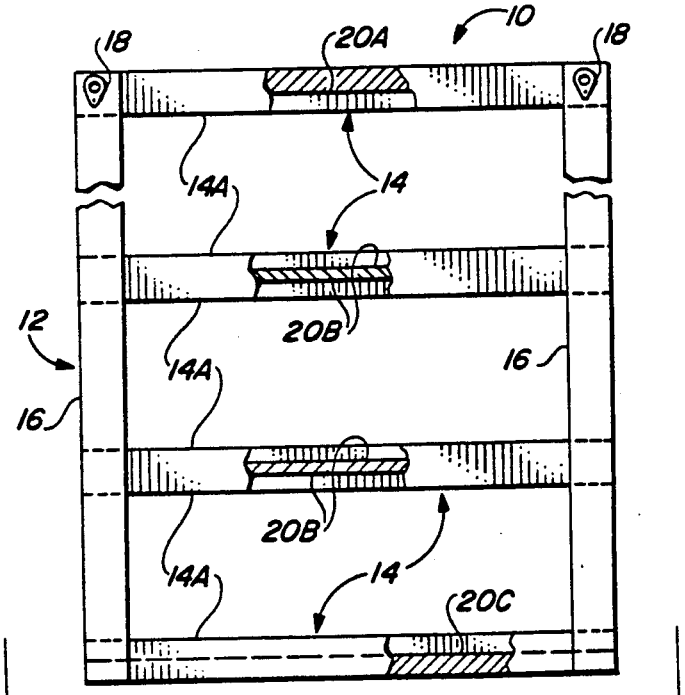
FIG. 2 is a foreshortened front elevational view of the wall-mounted display rack of FIG. 1.
Figure 6:
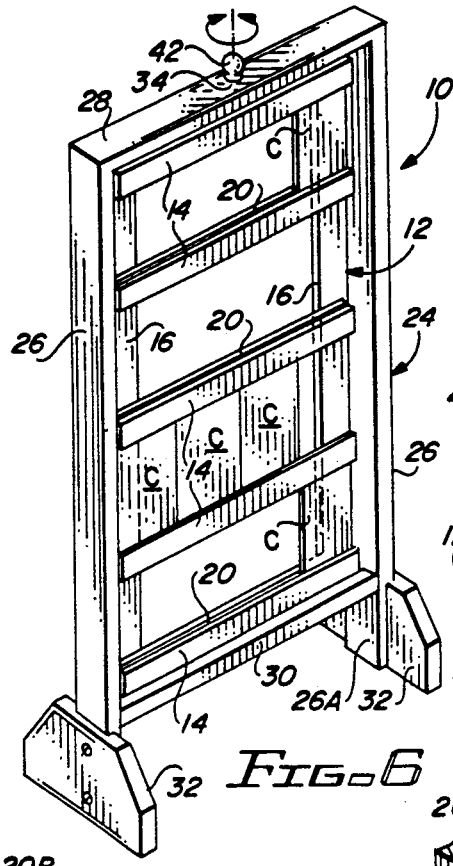
FIG. 6 is a perspective view of a freestanding embodiment of a display rack of the present invention.
Figure 7:
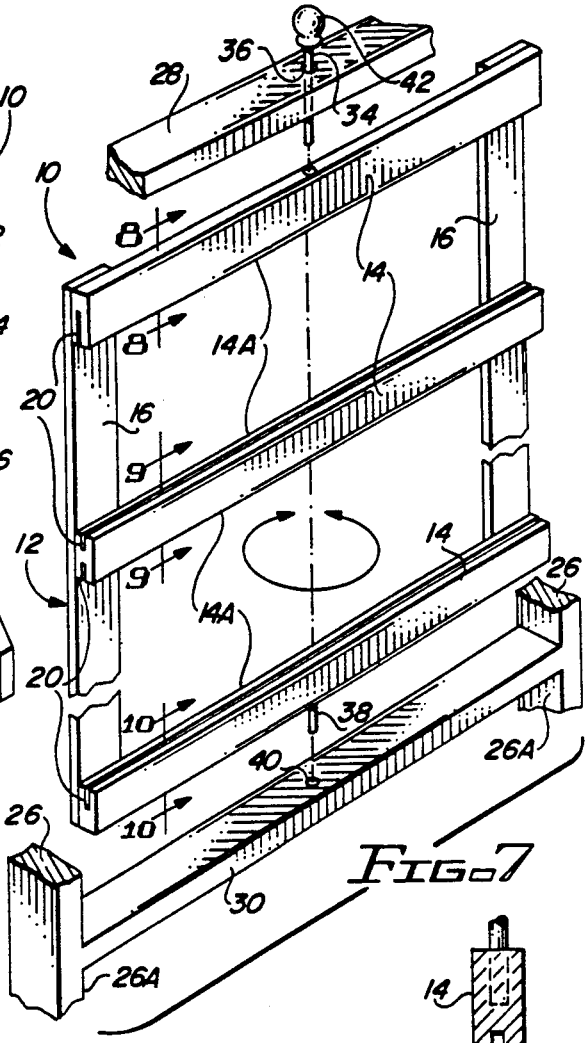
FIG. 7 is an exploded foreshortened view of the freestanding display rack of FIG. 6.
Figure 9:
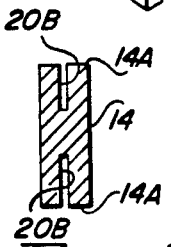
FIG. 9 is an enlarged cross-sectional view of a middle one of the rails of the display rack taken along line 9—9 of FIG. 7.
Figure 10:
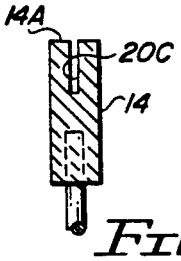
FIG. 10 is an enlarged cross-sectional view of a lowermost one of the rails of the display rack taken along line 10—10 of FIG. 7.
Figure 8:
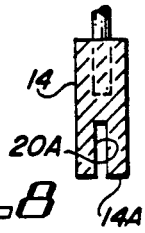
FIG. 8 is an enlarged cross-sectional view of an uppermost one of the rails of the display rack taken along line 8—8 of FIG. 7.
Figure 11:
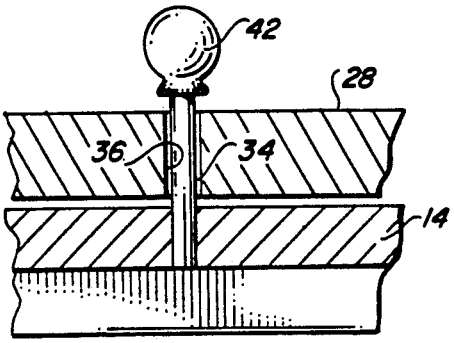
FIG. 11 is an enlarged fragmentary longitudinal sectional view of a middle upper portion of the display rack of FIG. 6.
Figure 12:
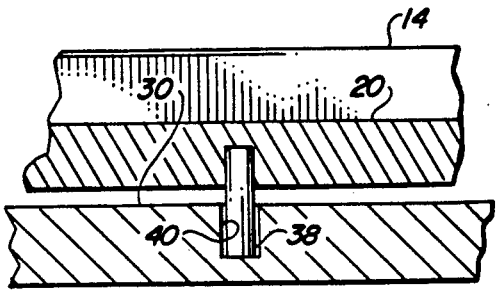
FIG. 12 is an enlarged fragmentary longitudinal sectional view of a middle lower portion of the display rack of FIG. 6.

Referring to FIGS. 3-5 and FIGS. 8-10, there is illustrated the linear grooves 20 recessed into the longitudinal surfaces 14A of the rails 1 which extend between and are open at opposite ends 14B of the rails 14. FIGS. 3 and 8 illustrate a downwardly open groove 20A formed in the lower longitudinal surface 14A of the uppermost rail 14. FIGS. 4 and 9 illustrate a pair of grooves 20B formed in the opposite upper and lower longitudinal surfaces 14A of one of the middle rails 14 which grooves 20B face in opposite directions. FIGS. 5 and 10 illustrate an upwardly open groove 20C formed in the upper longitudinal surface 14A of the lowermost rail 14.

The tie members 16 of the display structure 12 extend in generally transverse relation to the rails 14 and are rigidly attached by any suitable fastening means, such as screws or adhesive, to the opposite end portions 14C of the rails 14. The tie members 16 also extend along either the front or back sides of the opposite end portions 14C of the rails 14 so as to attach with the rails 14 in locations offset from the longitudinal surfaces 14A thereof which do not obstruct the grooves 20 on the rails 14 nor the sliding movement of the cards C in the grooves 20 between the rails 14.

Referring to FIGS. 6-12, there is illustrated a second embodiment of the display rack of the present invention, generally designated 22. The second embodiment of the display rack 22 is a freestanding unit.

Basically, the display rack 22 includes the above-described display structure 12 with a mounting frame 24 which surrounds and pivotally supports the display structure 12 for rotational movement relative to the mounting frame 24. The mounting frame 24 includes a pair of upright side members 26 and a pair of top and bottom members 28, 30 extending between and rigidly connecting the upright side members 26. Also, the display rack 22 includes a pair of base members 32 which are attached to lower end portions 26A of the side members 26 of the mounting frame 24 and are configured to support the mounting frame 24 and the display structure 12 therewith in an upright freestanding relation. The uppermost rail 14 and the top member 28 are pivotally coupled together at their midpoints by an upper pin 34 fixed to the upper rail 14 and extending upwardly through a passage 36 in the top member 28. The lowermost rail 14 and the bottom member 30 are pivotally coupled together at their midpoints by a lower pin 38 fixed to the lowermost rail 14 and extending downwardly through a passage 40 in the bottom member 30. The upper pin 34 extends through the passage 36 to above the top member 28 of the mounting frame 24 and has a knob 42 secured on its upper end for manually gripping to rotate the display structure 12 about a vertical axis defined by the upper and lower pins 34, 38.

It is though that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A display rack, comprising:

(a) a plurality of elongated rails having spaced opposite ends;

(b) means for supporting said rails in a common plane and in a generally parallel and vertically spaced relation to one another so as to locate at least a pair of said rails at a uniform distance from one another, said rails having longitudinal surfaces facing toward one another; and (c) means for defining tracks along said facing longitudinal surfaces of said pair of said rails, said tracks extending between and being open at said opposite ends of said pair of said rails for permitting inserting of card-like objects at either of said opposite ends of said pair of said rails into said tracks thereon and holding the card-like objects therebetween such that opposite end edges of the card-like objects extend within said tracks of said facing longitudinal surfaces of said pair of said rails and the card-like objects extend between said pair of said rails;

(d) said rail supporting means being attached to said rails so as to support said rails without obstructing said tracks on said pair of said rails nor said open opposite ends of said tracks.

2. The display rack of claim 1 wherein said track defining means formed along said facing longitudinal surfaces of the rails are linear grooves recessed into said longitudinal surfaces.

3. The display rack of claim 2 wherein said grooves extend between and are open at said opposite ends of said rails.

4. The display rack of claim 1 wherein said rail supporting means includes a pair of tie members extending in generally transverse relation to said rails and along one of the front or back sides of opposite end portions of said rails, said tie members being attached to said rails without obstructing said tracks nor said open opposite ends of said tracks on said rails.

5. The display rack of claim 2 wherein:

said rails include an uppermost rail and a lowermost rail; and said grooves include a groove facing and opening upwardly and being formed in a lower longitudinal surface of said uppermost rail and a groove facing an opening downwardly and being formed in an upper longitudinal surface of said lowermost rail.

6. The display rack of claim 2 wherein:

said rails include at least one middle rail disposed between and spaced from said uppermost and lowermost rails; and said grooves include a pair of grooves formed in opposite upper and lower longitudinal surfaces of said middle rail and opening and facing in opposite directions toward said grooves in said uppermost rail and lowermost rails.

7. The display rack of claim 1 wherein said rail supporting means includes a pair of tie members rigidly attached to said rails and extending in generally transverse relation to said rails.

8. The display rack of claim 1 wherein said rail supporting means includes:

a pair of tie members attached to said rails and extending in generally transverse relation to said rails so as to define a display structure therewith; and a freestanding mounting frame surrounding and pivotally supporting said display structure for rotational movement relative to said freestanding mounting frame.

9. The display rack of claim 8 wherein said freestanding mounting frame includes a pair of upright side members and a pair of top and bottom members extending between and connecting with said upright side members.

10. A display rack, comprising:

(a) a plurality of elongated rails having spaced opposite ends;

(b) means for supporting said rails in a common plane and in a generally parallel and vertically spaced relation to one another so as to locate at least a pair of said rails at a uniform distance from one another, said rails having longitudinal surfaces facing toward one another, said rail supporting means including a pair of tie members extending in a generally transverse relation to said rails and along one of front and back sides of opposite end portions of said rails; and (c) means for defining tracks along said facing longitudinal surfaces of said rails, said tracks extending between and being open at said opposite ends of said rails for holding card-like objects therebetween receivable from either of said opposite ends of said rails such that opposite end edges of the card-like objects extend within said tracks of said facing longitudinal surfaces of said pair of rails and the card-like objects extend between said rails, said tie members being attached to said rails without obstructing said open opposite ends of said tracks on said rails.

11. The display rack of claim 10 wherein said track defining means formed along said facing longitudinal surfaces of the rails are linear grooves recessed into said longitudinal surfaces.

12. The display rack of claim 10 wherein:

said rails include an uppermost rail, a lowermost rail an at least one middle rail disposed between and spaced from said uppermost rail and lowermost rail; and said grooves include a first groove facing and opening upwardly being formed in a lower longitudinal surface of said uppermost rail, a second groove facing and opening downwardly being formed in an upper longitudinal surface of said lowermost rail, and a pair of grooves formed in opposite upper and lower longitudinal surfaces of said middle rail and opening and facing in opposite directions toward said first and second grooves in said uppermost rail and lowermost rails.

13. A display rack, comprising:

(a) a plurality of elongated rails having spaced opposite ends;

(b) a display structure supporting said rails in a common plane and in a generally parallel and vertically spaced relation to one another so as to locate at least a pair of said rails at a uniform distance from one another, said rails having longitudinal surfaces facing toward one another;

(c) a freestanding mounting frame surrounding and pivotally supporting said display structure for rotational movement relative to said freestanding mounting frame; and (d) mean for defining tracks along said facing longitudinal surfaces of said pair of said rails, said tracks extending between and being open at said opposite ends of said pair of said rails for permitting inserting of card-like objects at either of said opposite ends of said pair of said rails into said tracks thereon and holding the card-like objects therebetween such that opposite end edges of the card-like objects extend within said tracks of said facing longitudinal surfaces of said pair of said rails and the card-like objects extend between said pair of said rails;

(e) said display structure including means attached to said rails so as to support said rails without obstructing said tracks on said pair of said rails nor said open opposite ends of said tracks.

14. The display rack of claim 13 wherein said track defining means formed along said facing longitudinal surfaces of the rails are linear grooves recessed into said longitudinal surfaces.

15. The display rack of claim 13 wherein said freestanding mounting frame includes a pair of upright side members and a pair of top and bottom members extending between and connecting with said upright side members.

16. The display rack of claim 15 wherein said freestanding mounting frame also includes a pair of base members being attached to either said bottom member or lower ends of said side members and configured to support said mounting frame and said display structure therewith in an upright freestanding relation.

17. The display rack of claim 15 wherein said top and bottom members are pivotally coupled to said display structure by respective upper and lower pins.

18. The display rack of claim 17 wherein said upper pin extends above said top member and has a knob secured on an upper end for manually gripping in order to rotate said display structure.

19. A display rack, comprising:

(a) a plurality of elongated rails having spaced opposite ends;

(b) means for supporting said rails in a common plane and in a generally parallel and vertically spaced relation to one another so as to locate at least a pair of said rails at a uniform distance from one another, said rails having longitudinal surfaces facing toward one another; and (c) means for defining tracks along said facing longitudinal surfaces of said pair of said rails, said tracks extending between said opposite ends of said rails for holding card-like objects therebetween such that opposite end edges of the card-like objects extend within said tracks of said facing longitudinal surfaces of said pair of rails and the card-like objects extend between said rails;

(d) said rail supporting means including (i) a pair of tie members attached to said rails and extending in generally transverse relation to said rails so as to define a display structure therewith, and (ii) a freestanding mounting frame surrounding and pivotally supporting said display structure for rotational movement relative to said freestanding mounting frame, said freestanding mounting frame including a pair of upright side members and a pair of top and bottom members extending between and connecting with said upright side members.

20. The display rack of claim 19 wherein said freestanding mounting frame also includes a pair of base members being attached to either said bottom member or lower ends of said side members and configured to support said mounting frame and said display structure therewith in an upright freestanding relation.

21. The display rack of claim 19 wherein said uppermost rail and top member are pivotally coupled together by an upper pin, and said lowermost rail and bottom member are pivotally coupled together by a lower pin.

22. The display rack of claim 21 wherein said upper pin extends above said top member and has a knob secured on an upper end for manually gripping in order to rotate said display structure.

* * * * *